US007423416B1

(12) United States Patent
Quinones et al.

(10) Patent No.: US 7,423,416 B1
(45) Date of Patent: Sep. 9, 2008

(54) VOLTAGE REGULATOR AND METHOD FOR PROVIDING A REGULATED OUTPUT

(75) Inventors: Bryan Quinones, Chandler, AZ (US); William E. Edwards, Ann Arbor, MI (US); Randall C. Gray, Tempe, AZ (US)

(73) Assignee: Freescale Semiconductor, Inc., Austin, TX (US)

( * ) Notice: Subject to any disclaimer, the term of this patent is extended or adjusted under 35 U.S.C. 154(b) by 0 days.

(21) Appl. No.: 11/853,939

(22) Filed: Sep. 12, 2007

(51) Int. Cl.
*G05F 3/16* (2006.01)

(52) U.S. Cl. ..... 323/314; 327/542

(58) Field of Classification Search ..... 323/312–317; 327/535, 538, 540, 541, 542, 543
See application file for complete search history.

(56) References Cited

U.S. PATENT DOCUMENTS 4,390,829 A 6/1983 Jarrett
4,743,833 A 5/1988 Johnson
4,879,506 A 11/1989 Braun
5,220,207 A * 6/1993 Kovalcik et al. ..... 327/432
5,339,020 A 8/1994 Siligoni et al.
5,444,358 A 8/1995 Delepaut
6,157,180 A * 12/2000 Kuo ..... 323/313

* cited by examiner

*Primary Examiner*—Jessica Han
(74) *Attorney, Agent, or Firm*—Kim-Marie Vo; Daniel D. Hill

(57) ABSTRACT

A voltage regulator includes first and second MOS transistors and a bipolar transistor. The first MOS transistor has a first conductivity type and has a drain coupled to a first power supply voltage terminal, a gate for receiving a first bias voltage, and a source. The second MOS transistor has a second conductivity type and has a source coupled to the first power supply voltage terminal, a drain coupled to the source of the first MOS transistor, and a gate for receiving a second bias voltage. The bipolar transistor has a collector coupled to the source of the first MOS transistor, a base for receiving a third bias voltage, and an emitter for providing an output voltage. The first MOS transistor and the second MOS transistor control a voltage level at the collector of the bipolar transistor in response to a varying power supply voltage provided to the first power supply voltage terminal.

20 Claims, 2 Drawing Sheets

–PRIOR ART–

VOLTAGE REGULATOR AND METHOD FOR PROVIDING A REGULATED OUTPUT

BACKGROUND

1. Field

This disclosure relates generally to voltage supply circuits, and more specifically, to voltage regulators and methods of providing a regulated output voltage.

2. Related Art

For efficient and desirable operation of electrical circuits, a constant voltage supply must be maintained at all operating conditions. Power supplies are used for providing a constant voltage to such electrical circuits. These power supplies or regulated power sources, receive as input an unregulated voltage, which may vary due to operational parameters, and provide an output voltage, which is fixed in magnitude and therefore called a regulated voltage.

FIG. 1 illustrates a prior art voltage regulator. The voltage regulator includes a first current source 12, a zener diode 14, a bipolar transistor 16, and a second current source 18. However, this voltage regulator cannot withstand high voltages (e.g., voltages greater than 20 V). In addition, the voltage regulator of FIG. 1 will have reduced performance at low voltages because the regulator drops out of regulation when the supply voltage is below the reference voltage. Therefore, a need exists for a regulator that can function over a wide range of voltages.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

In one embodiment, a voltage regulator and method for regulating a voltage that implements a switching scheme allowing operation in a low, intermediate, and high voltage modes. In one embodiment, an N-channel field effect transistor (FET) protects an output transistor during operation in the high voltage mode and a P-channel FET maintains operation in the intermediate voltage mode. In addition, a P-channel FET may be used to optimize the output voltage for voltage levels below the reference voltage.

While an NMOS (N channel metal oxide semiconductor) transistor can be used to allow the regulator to operate at high voltages (e.g. voltages greater than 20V), it has a greater voltage drop at larger load currents, has a slower response to transient load currents, and requires higher supply voltages to function than an npn transistor. Furthermore, the NMOS transistor may have leakage to the substrate above a voltage such as 10V. Although an npn transistor does not have these issues, an npn transistor cannot withstand collector-to-emitter voltages in excess of a voltage (e.g., 19V). Therefore, the npn transistor should be protected for supply voltages greater than this voltage plus the desired voltage. However, this protection may negatively impact the low and intermediate voltage operation of the regulator. In addition, the voltage regulator may drop out of regulation when the supply voltage falls below the reference voltage. When this occurs the output voltage will be approximately Vbe less than the supply voltage for an npn or be approximately Vgs below the supply voltage for an NMOS output transistor. The voltage regulator must output a minimum voltage (Vmin). Due to the extra Vbe or Vgs lost to the output device, the voltage regulator would cease to function at a supply voltage equal to Vmin plus the drop due to the output device. The proposed voltage regulator and its various embodiments prevent the above from happening and allow the regulator to function at low, intermediate, and high voltages.

Figure 1:
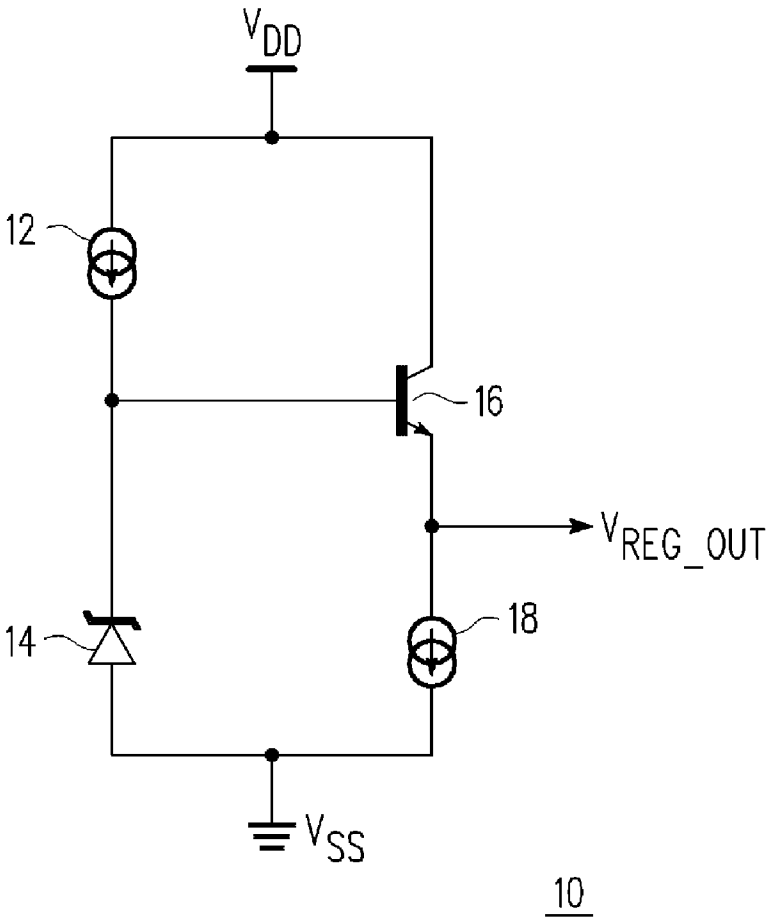
FIG. 1 illustrates a prior art voltage regulator.
Figure 2:
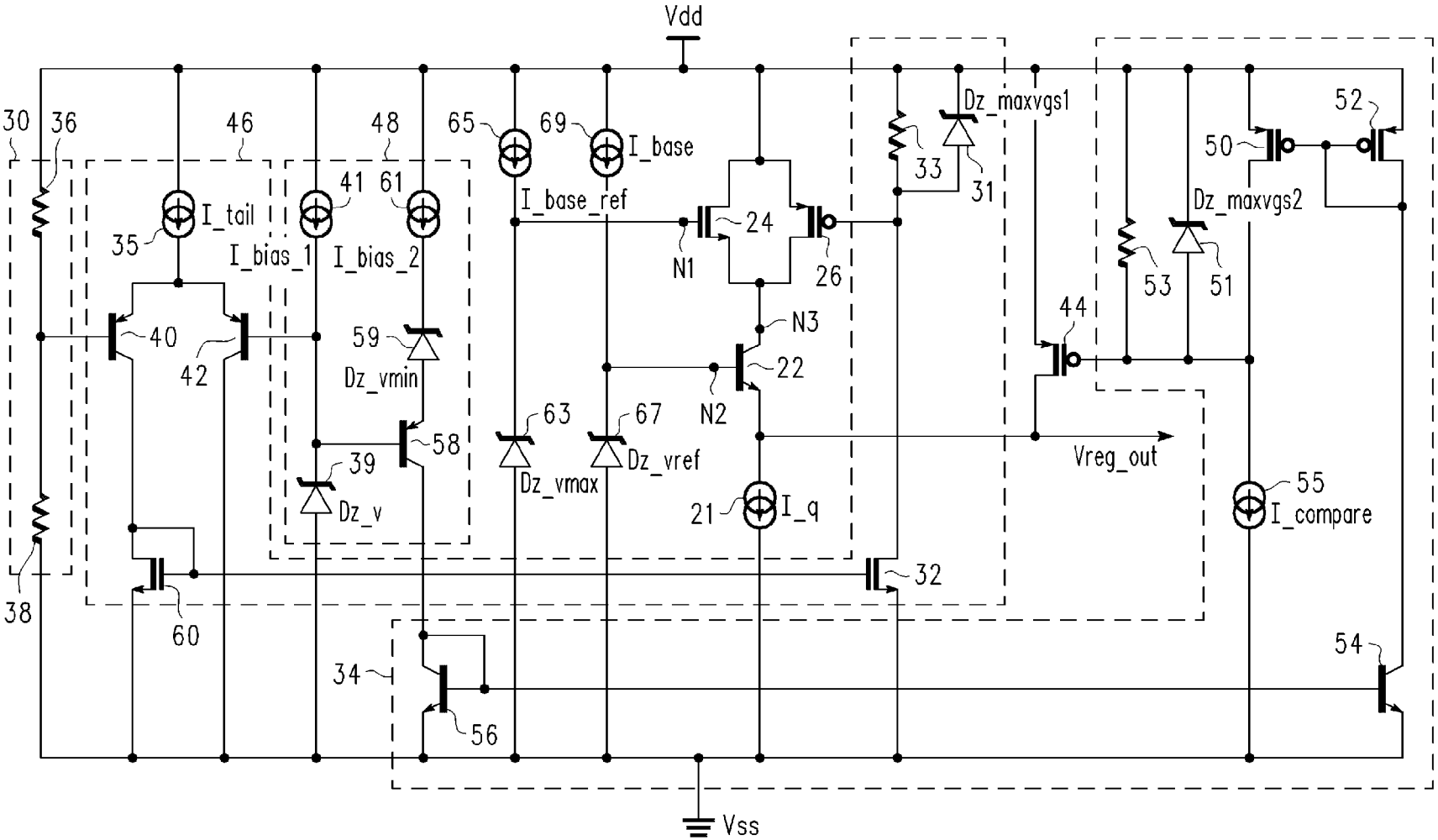
FIG. 2 illustrates a voltage regulator in accordance with one embodiment.

FIG. 2 illustrates a voltage regulator 20 in accordance with one embodiment. In one embodiment, the voltage regulator is one of many voltage regulators on a die that controls the chip. The voltage regulator 20 includes an output transistor 22 that provides an output voltage, Vreg_out. (All voltages described herein are with reference to Vss, which in one embodiment is ground.) The Vreg_out may drive a car ignition gate driver, an injector driver circuit, logic gates or any other suitable application. In one embodiment, the output transistor 22 is a bipolar junction transistor, such as an npn transistor.

The base of the output transistor 22 is coupled to current source 69 and voltage reference 67, which can be a voltage threshold generation circuit, through its base at node N2, which receives a bias voltage. The current source 65 is coupled to Vdd, which is a first power supply voltage, and sources I_base_ref to the first switch 24. The voltage reference 67 is coupled to Vss, which is a second power supply voltage, and the current source 69. In the embodiment illustrated, the voltage reference 67 as a zener diode. The voltage reference 67 generates voltage Dz_vref. In other embodiments, the voltage threshold generation circuit may be a band gap reference. The current source 69 and the voltage reference 67 provide a bias voltage at node N2. The bias voltage may be a pre-regulated reference voltage that will be buffered by the output transistor 22.

The output transistor 22 is coupled to a first switch 24, a second switch 26, and a third switch 44. The first switch 24 receives a bias voltage that is clamped to a predetermined maximum voltage (e.g., greater than 18V) to protect the output transistor 22 from a voltage higher than that which the output transistor can withstand. The second switch 26 supplies a voltage to the output transistor within a predetermined voltage range (e.g., 8V to 18V). The third switch 26 provides additional drive strength when a power supply voltage at a power supply terminal (e.g., Vdd) is below the predetermined voltage range (e.g., less than 8V).

In the embodiment illustrated, the collector of the output transistor 22 is coupled to a source of the first switch 24 and a drain of the second switch 26, and the emitter of the output transistor is coupled to a drain of the third switch 44. The emitter of the output transistor 22 is also coupled to current source 21, which sources current Iq and is coupled to Vss. The current Iq is a first current source having a first terminal coupled to the emitter of the output transistor 22 and a second terminal coupled to a second power supply voltage terminal (Vss). Although three switches are shown in FIG. 2, either the second switch 26 or the third switch 44 may not be present.

The first switch 24 is coupled to the collector node N3 of the output transistor and is turned on when the voltage regulator 20 is operating at a high voltage, which in one embodiment is greater than approximately 18V. In one embodiment, the first switch 24 is an NMOS transistor. Because the bipolar transistor will breakdown under the high voltage conditions, the first switch 24 and its associated circuitry protects the output transistor 22 during this high voltage operation mode. Thus, with the presence of the first switch 24 and its associated circuitry, the voltage regulator 20 can operate in the high voltage mode. The first switch 24, in one embodiment, has its gate coupled to a current source 65 and bias circuit 63, which may be a voltage reference at node N1 (e.g., a bias voltage.) The current source 65 and the bias circuit 63 provide a bias voltage to N1. This bias voltage may be a cascode or clamp voltage that protects the collector of the output transistor 22. The current source 65 is coupled to Vdd and sources current I_bias_2. The bias circuit is coupled to the current source 65, the first switch 24, and Vss. In the embodiment illustrated, the bias circuit 63 is a zener diode. However, the bias circuit can be a different device, such as a band gap reference.

The second switch 26, in one embodiment, is turned on when the voltage regulator 20 is operating in the intermediate mode, which is one embodiment occurs at voltages between approximately 8V and approximately 18V. In one embodiment, the second switch 26 is a PMOS (P-channel metal oxide semiconductor) transistor. The second switch 26 is coupled to an input voltage transfer function 30 and a comparator 46. The input voltage transfer function 30, in the embodiment illustrated, includes a resistor 36 and a resistor 38. The resistors 36 and 38 are a (voltage) divider and monitor Vdd. The resistors 36 and 38 are coupled between Vss and Vdd. The resistors 36 and 38 can divide Vdd by any desired amount (e.g., divide Vdd by 1). The input voltage transfer function 30 can be any number of resistors or any other suitable circuitry. In addition, the input voltage transfer function 30 may not be present and instead of the comparator 46 being coupled to the input voltage transfer function 30, as illustrated, it can be tied directly to Vdd.

The comparator 46 is also coupled to Vdd. The comparator 46 has an input terminal for receiving an input voltage from resistors 36 and 38, a second input terminal for receiving a reference voltage from voltage reference 39 and current source 41, and an output for controlling a bias voltage. The comparator 46 includes current source 35, bipolar transistor 40, bipolar transistor 42, transistor 60, transistor 32, resistor 33, and voltage reference 31. The current source 35 generates current I_tail and is coupled to Vdd and the emitters of the bipolar transistors 40 and 42. In one embodiment, both bipolar transistors 40 and 42 are pnp transistors. Coupled to the base of the bipolar transistor 42 is the current source 41, which generates I_bias_1, and the voltage reference 39, which generates voltage Dz_v. The base of bipolar transistor 40 is the input voltage transfer function 30, if present, or Vdd if the input voltage transfer function 30 is not present. The collector of the bipolar transistor 42 is coupled to Vss. The collector of the bipolar transistor 40 is coupled to the drain of the transistor 60. The source of the transistor 60 is coupled to Vss and the gate of the transistor 60 is coupled to the gate of the transistor 32. Furthermore, the drain and gate of the transistor 60 are tied together. Transistors 60 and 32 are current mirrors 60 and 32, which may be NMOS transistors. The source of the transistor 32 is coupled to Vss. The drain of the transistor 32 is coupled to a voltage reference 31 and resistor 33, which are also coupled to the gate of the second switch 26. The voltage reference 31 can be a zener diode and can generate Dz_maxvgs1. The drain of the second switch 26 is also coupled to the output transistor 22 and the first switch 24. In the embodiment illustrated, when the second switch 26 is turned on by the input voltage transfer function 30 and the comparator 46, the second switch 26 changes, (e.g., increasing) the source voltage of the first switch 24. Because the gate voltage of the first switch 24 is constant, if the source voltage of the first switch 24 is increased, the gate to source voltage is decreased and the first switch 24 turns off. Hence, a conductance of the second switch 26, as determined by the first supply voltage (in this embodiment Vdd), the comparator 46, the bias voltage that is from voltage reference 31, transistor 32, and resistor 33, at least partially controls a conductance of the first switch 24.

The third switch 44, in one embodiment, is turned on when the voltage regulator 20 is operating in the low voltage mode, which in one embodiment occurs at voltages less than approximately 8V. In one embodiment, the third switch 44 is a PMOS transistor. The third switch 44 is coupled to an input voltage transfer function 48 and a comparator 34. The input voltage transfer function 48, in the embodiment illustrated, includes current source 61, voltage reference 59, bipolar transistor 58, current source 41, and voltage reference 39. The current source 61 is coupled to Vdd and generates current I_bias_2. The current source 61 is also coupled to the voltage reference 59, which monitors the supply voltage and generates voltage Dz_vmin. The voltage reference 59 is coupled to the emitter of the bipolar transistor 58. The voltage reference 39 is coupled to the base of the bipolar transistor 58. The current source 41 is coupled to Vdd and sources current I_bias_1. In other embodiments, the input voltage transfer function 48 is similar to the input voltage transfer function 30. Likewise, the input voltage transfer function 30 could be similar to the input voltage transfer function 48; for example, the input voltage transfer function 30 may not include the resistors 36 and 38. The collector of the bipolar transistor 58 is coupled to the transistor 56, which is part of the comparator 34.

The comparator 34 includes transistors 56 and 54, current source 55, voltage reference 51, resistor 53, and transistors 50 and 52. Transistors 56 and 54 are current mirrors that may include npn bipolar transistors. The bases of the transistors 56 and 54 are coupled. The collector of the transistor 56 is coupled to the collector of the transistor 58. The emitter of the transistor 56 is coupled to Vss. Furthermore, the collector and base of the transistor 56 are coupled. The emitter of the transistor 54 is also coupled to Vss. The collector of transistor 54 is coupled to transistor 52. Transistor 52 is in the embodiment illustrated a PMOS transistor. Its drain is coupled to the collector of transistor 54 and to its gate. The source of transistor 52 is coupled to the source of transistor 50, which in the embodiment illustrated is also a PMOS transistor. Transistor 50 has a gate coupled to the gate and drain of the transistor 52 and a drain coupled to the current source 55, which generates I_compare and is coupled to Vss. the drain of the transistor 50 is also coupled to the voltage reference 51, the resistor 53, and the gate of the third switch 44. The voltage reference 51 can be a zener diode coupled to Vdd. The voltage reference 51 generates Dz_maxvgs2. Resistor 53 is coupled to Vdd.

During the operation of the voltage regulator 20, if the saturation voltage of all current sources are negligible, the load current is defined as I_load, the Rdson of the second switch 26 is Rp(26) and the Rdson or the third switch 44 is defined as Rp(44), the following occurs. When operating in the intermediate or high mode, Vdd>Dz_ref. In this mode the first switch 24 or the second switch 26 are on, the output transistor 22 is on, and the third switch 44 is off. The current, I_base, flows through Dz_vref. Hence, Vreg_out=Dz_vref−Vbe(22). In the intermediate mode, the following conditions can occur: Dz_vref>Vdd>Dz_v+Vbe(58)+Dz_vmin and, thus, Vreg_out=Vdd−Vbe(22).

When operating in the low voltage mode, Vdd<Dz_v+Vbe(58)+Dz_vmin and the transistor 58 turns off. This disables the current through the current mirrors 54 and 56, which shuts off the transistor 50. When the transistor 50 is off, the current from the current source 55 (I_compare) enhances the third switch 44. Thus, Vreg_out=Vdd−I_load*Rp(44). In this example, Dz_vref>Dz_vmin+Dz_v+Vbe(58) so that the output voltage is never larger than Dz_vref.)

To protect the output transistor 22 from the voltages in the modes that are above the voltage that it can sustain from its collector to emitter (BVceo) prior to breakdown (which may be voltages above approximately 19.2V), the first switch 24 with higher voltage capability is used. The collector voltage of the output transistor is Vc(22)=Dz_vmax−Vgs(24) for Vdd>Dz_vmax. If the transistor 26 is ignored, then for Vdd<Dz_vmax, Vc(22)=Vdd−Vgs(24). Thus, Vc(22) equals the base voltage of output transistor 22 (Vb(22)) when Dz_vmax−Vgs(24)=Dz_vref. If Vc(22)<Vb(22) then a parasitic such as a substrate pnp, is activated and the base current of the output transistor 22 is partially diverted to the substrate. This diversion of current decreases the output current capability of the output transistor 22. To prevent or minimize the decrease in output current the second switch 26 may be activated so Vc(22)>Vb(22) and the collector voltage of the output transistor 22 is Vdd−Rp(26)*I_load. The activation voltage of the second switch 26 may occur when Vdd*R38/(R36+R38) is lower than Dz_v. By setting the switching point above Dz_ref, the collector voltage of the output transistor 22 can be greater than its base voltage.

In one embodiment, a voltage regulator includes a first metal oxide semiconductor (MOS) transistor having a first conductivity type, the first MOS transistor having a drain coupled to a first power supply voltage terminal, a gate for receiving a first bias voltage, and a source; a second MOS transistor having a second conductivity type different than the first conductivity type, the second MOS transistor having a source coupled to the first power supply voltage terminal, a drain coupled to the source of the first MOS transistor, and a gate for receiving a second bias voltage; a bipolar transistor having a collector coupled to the source of the first MOS transistor, a base for receiving a third bias voltage, and an emitter for providing an output voltage; and a first current source having a first terminal coupled to the emitter of the bipolar transistor, and a second terminal coupled to a second power supply voltage terminal; wherein the first MOS transistor and the second MOS transistor control a voltage level at the collector of the bipolar transistor in response to a varying power supply voltage provided to the first power supply voltage terminal.

In one embodiment, a voltage regulator includes an output transistor having a first current electrode, a second current electrode coupled to an output terminal for providing a regulated output voltage, and a control electrode for receiving a first bias voltage; a first transistor having a first current electrode coupled to a first power supply voltage terminal, a second current electrode coupled to the first current electrode of the output transistor, and a control electrode for receiving a second bias voltage, wherein the second bias voltage is clamped to a predetermined maximum voltage to protect the output transistor from a voltage higher than the output transistor can withstand; a second transistor having a first current electrode coupled to the first power supply voltage terminal, a second current electrode coupled to the first current electrode of the first transistor, and a control electrode for receiving a third bias voltage, wherein the second transistor for supplying a voltage to the output transistor within a predetermined voltage range; and a third transistor having a first current electrode coupled to the first power supply voltage terminal, a second current electrode coupled to the output terminal, and a control electrode for receiving a fourth bias voltage, wherein the fourth bias voltage for causing the third transistor to provide additional drive strength when a power supply voltage at the first power supply terminal is below the predetermined voltage range.

In one embodiment, a method for providing a regulated output voltage includes providing an output transistor and first and second transistors, the output transistor having a first current electrode, a second current electrode coupled to an output terminal for providing the regulated output voltage, and a control electrode, the first transistor having a first current electrode coupled to a first power supply voltage terminal, a second current electrode coupled to the first current electrode of the output transistor, and a control electrode, and a second transistor having a first current electrode coupled to the first power supply voltage terminal, a second current electrode coupled to the first current electrode of the first transistor, and a control electrode; biasing the control electrode of the output transistor with a first bias voltage; biasing the control electrode of the first transistor with a second bias voltage, the second bias voltage being clamped to a predetermined maximum voltage to protect the output transistor from a voltage higher than the output transistor can withstand; and biasing the control electrode of the second transistor with a third bias voltage, the third bias voltage for supplying a voltage to the output transistor within a predetermined voltage range.

By now it should be appreciated that there has been provided a voltage regulator and method for regulating a voltage that allows for a high operational voltage, intermediate voltage capability, or low voltage capability, or all three voltage modes. Besides operating over a broad range of supply voltages, the voltage regulator has good transient performance.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention. Although the invention has been described with respect to specific conductivity types or polarity of potentials, skilled artisans appreciated that conductivity types and polarities of potentials may be reversed.

Some of the above embodiments, as applicable, may be implemented using a variety of different circuitry. For example, although FIG. 2 and the discussion thereof describe an exemplary architecture, this exemplary architecture is presented merely to provide a useful reference in discussing various aspects of the invention. Of course, the description of the architecture has been simplified for purposes of discussion, and it is just one of many different types of appropriate architectures that may be used in accordance with the invention. Those skilled in the art will recognize that the boundaries between blocks are merely illustrative and that alternative embodiments may merge blocks or circuit elements or impose an alternate decomposition of functionality upon various blocks or circuit elements.

Thus, it is to be understood that the architectures depicted herein are merely exemplary, and that in fact many other architectures can be implemented which achieve the same functionality. In an abstract, but still definite sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermediate components. Likewise, any two components so associated can also be viewed as being "operably connected," or "operably coupled," to each other to achieve the desired functionality.

Although the invention is described herein with reference to specific embodiments, various modifications and changes can be made without departing from the scope of the present invention as set forth in the claims below. For example, the voltage references can be changed from a zener diode and current source to a band gap reference. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling. Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles. Unless stated otherwise, terms such as "first" and "second" are used to arbitrarily distinguish between the elements such terms describe. Thus, these terms are not necessarily intended to indicate temporal or other prioritization of such elements.

What is claimed is:

1. A voltage regulator comprising:

a first metal oxide semiconductor (MOS) transistor having a first conductivity type, the first MOS transistor having a drain coupled to a first power supply voltage terminal, a gate for receiving a first bias voltage, and a source;

a second MOS transistor having a second conductivity type different than the first conductivity type, the second MOS transistor having a source coupled to the first power supply voltage terminal, a drain coupled to the source of the first MOS transistor, and a gate for receiving a second bias voltage;

a bipolar transistor having a collector coupled to the source of the first MOS transistor, a base for receiving a third bias voltage, and an emitter for providing an output voltage; and a first current source having a first terminal coupled to the emitter of the bipolar transistor, and a second terminal coupled to a second power supply voltage terminal;

wherein the first MOS transistor and the second MOS transistor control a voltage level at the collector of the bipolar transistor in response to a varying power supply voltage provided to the first power supply voltage terminal.

2. The voltage regulator of claim 1, wherein a conductance of the second MOS transistor, as determined by the second bias voltage, at least partially controls a conductance of the first MOS transistor.

3. The voltage regulator of claim 1, further comprising:

a second current source having a first terminal coupled to the first power supply voltage terminal, and a second terminal coupled to the gate of the first MOS transistor for providing the first bias voltage; and a voltage reference having a first terminal coupled to the gate of the first MOS transistor, and a second terminal coupled to the second power supply voltage terminal.

4. The voltage regulator of claim 3, wherein the voltage reference comprises a zener diode.

5. The voltage regulator of claim 1, further comprising a comparator having a first input for receiving an input voltage, a second input for receiving a reference voltage, and an output for controlling the second bias voltage.

6. The voltage regulator of claim 5, wherein the input voltage is provided by a voltage divider coupled between the first and second power supply voltage terminals.

7. The voltage regulator of claim 1, further comprising:

a second current source having a first terminal coupled to the first power supply voltage terminal, and a second terminal coupled to the base of the bipolar transistor for providing the third bias voltage; and a voltage reference having a first terminal coupled to the base of the bipolar transistor, and a second terminal coupled to the second power supply voltage terminal.

8. The voltage regulator of claim 1, further comprising:

a third transistor having a source coupled to the first power supply voltage terminal, a gate for receiving a fourth bias voltage, and a drain coupled to the emitter of the bipolar transistor; and an input voltage transfer function having a first input for receiving an input voltage, a second input for receiving a reference voltage, and an output for controlling the fourth bias voltage.

9. A voltage regulator comprising:

an output transistor having a first current electrode, a second current electrode coupled to an output terminal for providing a regulated output voltage, and a control electrode for receiving a first bias voltage;

a first transistor having a first current electrode coupled to a first power supply voltage terminal, a second current electrode coupled to the first current electrode of the output transistor, and a control electrode for receiving a second bias voltage, wherein the second bias voltage is clamped to a predetermined maximum voltage to protect the output transistor from a voltage higher than the output transistor can withstand;

a second transistor having a first current electrode coupled to the first power supply voltage terminal, a second current electrode coupled to the first current electrode of the first transistor, and a control electrode for receiving a third bias voltage, wherein the second transistor for supplying a voltage to the output transistor within a predetermined voltage range; and a third transistor having a first current electrode coupled to the first power supply voltage terminal, a second current electrode coupled to the output terminal, and a control electrode for receiving a fourth bias voltage, wherein the fourth bias voltage for causing the third transistor to provide additional drive strength when a power supply voltage at the first power supply terminal is below the predetermined voltage range.

10. The voltage regulator of claim 9, further comprising a current source having a first terminal coupled to the second current electrode of the output transistor, and a second terminal coupled to a second power supply voltage terminal.

11. The voltage regulator of claim 9, further comprising:

a current source having a first terminal coupled to the first power supply voltage terminal, and a second terminal coupled to the control electrode of the output transistor; and a voltage reference having a first terminal coupled to the second terminal of the current source, and a second terminal coupled to a second power supply voltage terminal, wherein the current source and voltage reference are for providing the first bias voltage.

12. The voltage regulator of claim 9, further comprising:

a current source having a first terminal coupled to the first power supply voltage terminal, and a second terminal coupled to the control electrode of the first transistor; and a voltage reference having a first terminal coupled to the second terminal of the current source, and a second terminal coupled to a second power supply voltage terminal, wherein the current source and voltage reference are for providing the second bias voltage.

13. The voltage regulator of claim 9, further comprising a comparator having an input for receiving an input voltage, a second input for receiving a reference voltage, and an output for controlling the third bias voltage.

14. The voltage regulator of claim 13, further comprising a level shifter having an input terminal coupled to the output of the comparator, and an output terminal coupled to the control electrode of the second transistor.

15. The voltage regulator of claim 9, further comprising an input voltage transfer function having a first input for receiving an input voltage, a second input for receiving a reference voltage, and an output for controlling the fourth bias voltage.

16. The voltage regulator of claim 9, wherein the voltage regulator is used to regulate a supply voltage provided to circuitry on an integrated circuit.

17. The voltage regulator of claim 9, wherein the output transistor is characterized as being a bipolar transistor, the first transistor is characterized as being an N-channel transistor, and the second and third transistors are characterized as being P-channel transistors.

18. A method for providing a regulated output voltage, the method comprising:

providing an output transistor and first and second transistors, the output transistor having a first current electrode, a second current electrode coupled to an output terminal for providing the regulated output voltage, and a control electrode, the first transistor having a first current electrode coupled to a first power supply voltage terminal, a second current electrode coupled to the first current electrode of the output transistor, and a control electrode, and a second transistor having a first current electrode coupled to the first power supply voltage terminal, a second current electrode coupled to the first current electrode of the first transistor, and a control electrode;

biasing the control electrode of the output transistor with a first bias voltage;

biasing the control electrode of the first transistor with a second bias voltage, the second bias voltage being clamped to a predetermined maximum voltage to protect the output transistor from a voltage higher than the output transistor can withstand; and biasing the control electrode of the second transistor with a third bias voltage, the third bias voltage for supplying a voltage to the output transistor within a predetermined voltage range.

19. The method of claim 18, further comprising providing a third transistor having a first current electrode coupled to the first power supply voltage terminal, a second current electrode coupled to the output terminal, and a control electrode; and biasing the control electrode of the third transistor with a fourth bias voltage, the fourth bias voltage for causing the third transistor to provide additional drive strength when a power supply voltage at the first power supply voltage terminal is below the predetermined voltage range.

20. The method of claim 18, wherein providing an output transistor and first and second transistors further comprises providing a bipolar output transistor and metal oxide semiconductor (MOS) first and second transistors.

* * * * *